United States Patent [19]

Khee

[11] 3,973,482

[45] Aug. 10, 1976

[54] APPLIANCE FOR CUTTING HALF-BOILED EGGS

[76] Inventor: Sio Pway Khee, 1A, S.N. Banerjee Road, Calcutta-3, West Bengal, India

[22] Filed: Oct. 24, 1974

[21] Appl. No.: 517,835

[52] U.S. Cl. ..... 99/537

[51] Int. Cl.[2] ..... A23N 15/00; A23N 17/00; A47J 29/06

[58] Field of Search ..... 99/537, 509, 576

[56] References Cited

UNITED STATES PATENTS

| | | | |
|---|---|---|---|
| 1,727,465 | 9/1929 | Hamilton | 99/576 X |
| 2,172,892 | 9/1939 | Sepelak et al. | 99/576 X |
| 3,090,413 | 5/1963 | Rossi | 99/576 X |
| 3,229,739 | 1/1966 | Ellis et al. | 99/509 |

FOREIGN PATENTS OR APPLICATIONS

| | | | |
|---|---|---|---|
| 167,059 | 12/1905 | Germany | 99/576 |
| 853,840 | 11/1960 | United Kingdom | 99/576 |

*Primary Examiner*—Leonard D. Christian
*Assistant Examiner*—Donald B. Massenberg
*Attorney, Agent, or Firm*—Haseltine, Lake & Waters

[57] ABSTRACT

Opener for half-boiled eggs, comprising two parts, namely a lower half serving as a container for holding the egg and, an upper half serving as a means for tightening the hold of the egg opener on the egg; and a cutting blade which is preferably pivotably mounted on the top of the upper half. The lower half of the egg opener is preferably provided with a tension absorber on which the egg can be placed, while the upper half can be fitted with a safety blade-stop for preventing further movement of the blade after the egg has been sliced off.

9 Claims, 9 Drawing Figures

APPLIANCE CUTTING HALF-BOILED EGGS

This invention relates to a half-boiled egg opener.

The usual practice of breaking a half-boiled egg is to break it with a spoon. Such a crude method usually results in a complete crumbling of the egg-shell and the spilling of the semi-liquid egg, thereby spoiling the table cloth.

It has already been proposed to provide a half-boiled egg opener which is in the nature of a metal forceps for holding the half-boiled egg when it is being opened. This holder has the draw-back that when the metal forceps holds the egg firmly, it could easily smash the egg-shell completely and thereby render the process clumsy.

This invention has for its object an improved half-boiled egg opener which will not only open the half-boiled egg without breaking it, but also cut the half-boiled egg neatly and evenly.

The improved half-boiled egg opener according to this invention has, in combination, two parts, namely a lower half and an upper half, the lower half serving as a container for holding the half-boiled egg, and the upper half serving as a means for tightening the hold of the egg, opener on the egg firmly to the required extent; and a cutting blade provided on the upper half.

According to further inventive features the upper half is slightly larger than, and overlaps, the lower half (which is small), and the two halves are provided with means such as screw-threads so that they can be tightened to the required extent to hold the egg firmly before its top end is cut open.

The upper half is preferably provided with an aperture through which the top end of the half-boiled egg extend outward for being cut open by a cutting blade.

The cutting blade may be pivotally mounted on the top of the upper half of the egg opener, and a portion of the cutting blade may be made pointed and adapted to be brought into contact with the egg to puncture the egg-shell before the rest of the blade proceeds to cut the egg.

The lower half of the improved half-boiled egg opener may be provided with a tension absorber on which the egg can be placed and will rest for being cut with the blade. The tension absorber may be of a cylindrical or any other shape; it may be of any flexible substance such as a plastic, and it may be made in one piece with the lower part of the egg opener, or as a separate piece which can be placed inside the lower part, and which will stand upright therein.

When made as a separate piece, it may have a flat base adapted to extend outward to the inner wall of the lower half of the opener, so that it cannot slide away from a central position in relation to the lower half.

The tension absorber can also be provided with slits running from its upper edge downward to half its height.

As a further improvement the improved half-boiled egg opener may be fitted with a safety plate having means such as a stop-flange or an abutment which will prevent the knife from inflicting any cut on the operator as a result of the blade accidentally moving too far after the egg top has been sliced off.

These and other features of this invention will now be more particularly described with reference to the accompanying drawings, in which.

Figure 1:
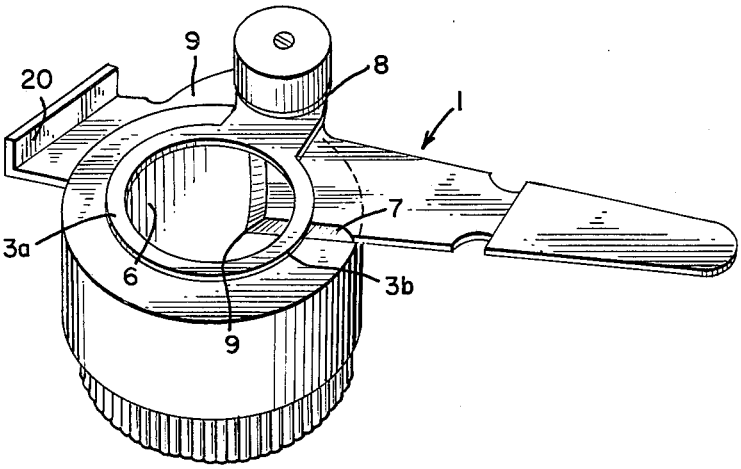
FIG. 1 is the front view of a half-boiled egg opener according to this invention.
Figure 5:
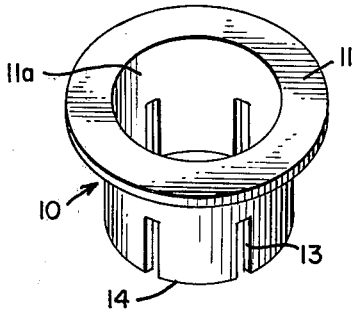
FIG. 5 is a view of the tension absorber from the bottom.

The half-boiled egg opener 1 illustrated in the drawings consists of two parts namely a lower half 2 and an upper half 3, the lower half serving as a container for holding the half-boiled egg, and the upper half 3 serving as a means for tightening the hold of the egg opener on the egg firmly to the required extent.

The upper half 3 is larger than, and it overlaps, the lower half 2; and both halves 2 and 3 are provided with threads 4 and 5 respectively so that they can be tightened to the required extent to hold the egg firmly before its top end is cut open.

The upper half 3 is also provided with an aperture 6 through which the top end of the "half boiled" egg can extend outward for being cut open by a blade 7 which is preferably hingedly fitted on the top of the upper half 3, as shown at 8.

Figure 9:
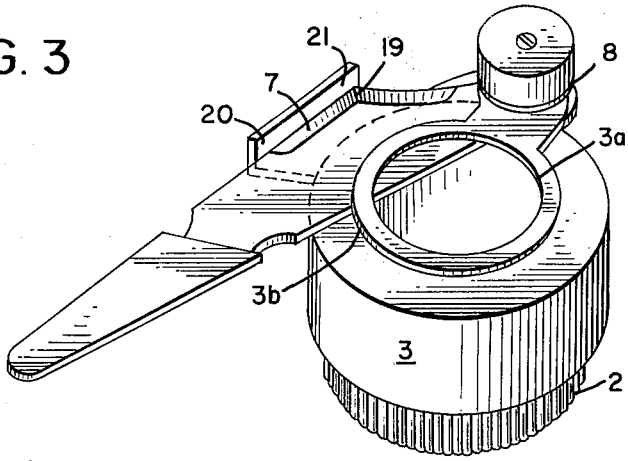
FIG. 9 shows how the abutment formed on the safety blade-stop prevents further movement of the blade after the egg top has been sliced off.

As can be seen in FIGS. 1 and 9, the upper half 3 has a protruding portion **3*a*, associated with the part where the hinge 8 is provided for the blade 7. Between the flat top of half 3 and the portion 3*a* there is a narrow gap or slit 3*b* into which the blade 7 can be moved, thereby to cut the half-boiled egg within the opener 1 (between is parts or halves 2 and 3**).

A portion 9 of the said blade 7 can be made pointed and is adapted to be brought into contact with the egg to puncture the egg-shell before the rest of the blade proceeds to cut the egg.

The lower half 2 contains a tension absorber 10, which is cylindrical in shape, and which has a flat base 11 extending outward to the inner wall 12 of the lower half 2. An aperture **11*a* is provided in the base 11**, through which the half-boiled egg may be pushed out and removed, in case it is not easily removable.

The tension absorber 10 has also slits 13 extending from its upper edge 14 downward to a level 15, at about half its height.

The half-boiled egg opener functions as follows:

A half-boiled egg is placed on the tension absorber 10, preferably standing inside the lower half 12, and then the upper half 3 is screwed on and tightened on the lower half 2 to the extent necessary to hold the egg firmly, with its top end extending outward through the aperture 6. The blade 7 is then moved towards the egg, and in doing so, its pointed end 9 will be first brought into contact with the egg and will puncture the egg-shell, and thereafter it will proceed to cut the egg neatly and evenly.

Figure 2:
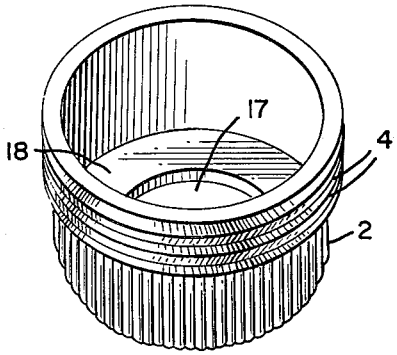
FIG. 2 shows the lower half of the opener.
Figure 6:
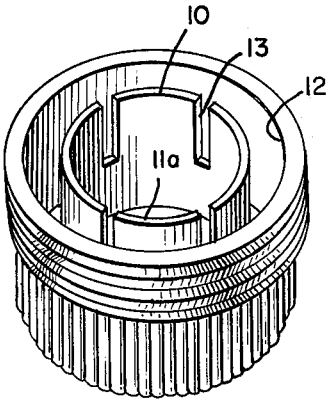
FIG. 6 shows a tension absorber made in one piece with the lower half of the opener.
Figure 7:
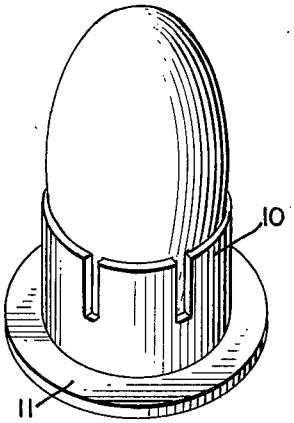
FIG. 7 shows a tension absorber with an egg held thereon.

The lower half 2 of FIGS. 1 and 2 has a flat bottom 18 with an aperture 17 therein, substantially aligned with the aperture 6 in the upper half 3, facilitating removal of the egg, away from where the blade 7 is mounted.

Figure 8:
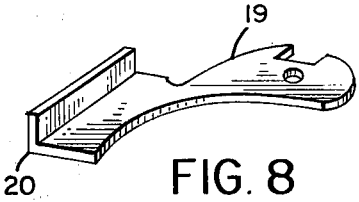
FIG. 8 shows a safety blade-stop fitted on the upper half of the opener.
Figure 3:
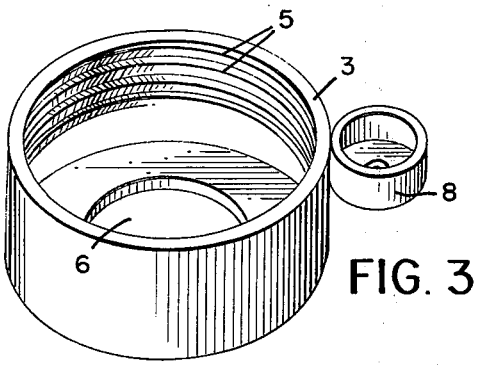
FIG. 3 shows the upper half of the said opener,in an inverted position (with the top down).
Figure 4:
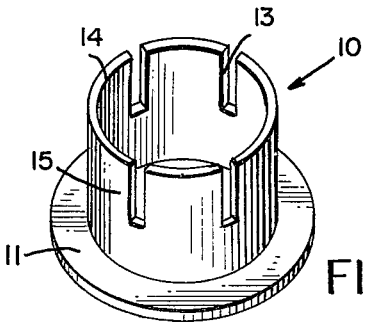
FIG. 4 is a view of the tension absorber from the top.

FIG. 8 shows a safety blade-stop 19 which has an abutment 20 which will prevent the blade 7 from moving further as shown at 21 in FIG. 9, after the egg top has been sliced off.

It is to be understood that the half-boiled egg opener illustrated in the drawings has been described merely by way of an example, and not by way of any limitation of this invention; and that it can be modified in various ways without departing from the spirit of this invention.

For instance, instead of joining the lower half of the opener with its upper half by means of screw-threads, the two halves may be joined by means of a bayonet-type joint. The bayonet-type joint will provide a simpler means of joining the two halves, as it would merely be necessary to place the upper cover over the opener base and allow it to descend until the top of the egg abutted the periphery of the orifice in the opener cover, and then to give the opener cover a twist through a distance of say 3/4¾ to lock the opener cover to the opener base.

Another modification which may be made is to provide an additional stop-flange so as to form an abutment against the non-cutting edge of the knife. This will reduce the risk of the exposed cutting edge inflicting any cuts on a careless operator, and it will constitute a safety factor when the opener is operated by children.

I claim:

1. An opener for half-boiled eggs, comprising, in combination: two major component parts, namely a first part serving as a container for an egg that can be inserted therein, and a second part serving as a means for tightening the hold of the opener on the inserted egg; means for releasably connecting said two parts, said means comprising internal threads on the inside surface of the lower portion of said second part, and external threads on the outside surface of the upper portion of said first part; one of said two parts including a portion with a substantially axial aperture therein, large enough to allow the top of the inserted egg to extend to the outside; said portion defining with planar portions of said second part a narrow gap that extends from one side of the opener to the other; and an elongate cutting blade pivotally secured at one end to said planar portions of the second part, manually movable in said gap to slice off the top of the egg and thus decapitate the inserted egg.

2. The egg opener as defined in claim 1, wherein said second part is slightly larger than and overlaps said first part, which is smaller, said second part constitutes said one part having said portion that defines said narrow gap with said planar portions of the second part, and said parts are provided with means for tightening them to hold the inserted egg firmly before said cutting blade is operated across said gap.

3. The egg opener as defined in claim 1, wherein a portion of said cutting blade closer to its pivoted end is pointed, to be brought first into contact with the egg, to puncture its shell before the rest of said blade contacts and decapitates the egg.

4. The egg opener as defined in claim 1, further comprising a stationary safety blade stop fitted on said top portion of the second part, for preventing further movement of said cutting blade after it has been moved across said gap from said one side of the opener to said other side.

5. The egg opener as defined in claim 1, wherein the other of said parts also has an aperture therein, substantially axially aligned with said aperture of the one part, allowing the egg to be removed from the opener upon completion of the operation.

6. The egg opener as defined in claim 1, further comprising a tension absorber inside said first part, on which the egg can be placed and can rest for being decapitated with said cutting blade.

7. The egg opener as defined in claim 6, wherein said tension absorber is provided with slits running from its outer edge downward to about half of its height to increase its resilience.

8. The egg opener as defined in claim 6, wherein said tension absorber is a separate cylindrical part made of plastic and supported in a standing position inside said first part.

9. The egg opener as defined in claim 8, wherein said tension absorber has a flat base extending outward substantially to the inner wall of said first part so that said tension absorber is prevented from sliding away from a central position in relation to said first part.

* * * * *